US010818412B2

(12) United States Patent
Uegaki et al.

(10) Patent No.: US 10,818,412 B2
(45) **Date of Patent: *Oct. 27, 2020**

(54) COMMUNICATION CABLE

(71) Applicants: AUTONETWORKS TECHNOLOGIES, LTD., Yokkaichi-shi, Mie (JP); SUMITOMO WIRING SYSTEMS, LTD., Yokkaichi-shi, Mie (JP); SUMITOMO ELECTRIC INDUSTRIES, LTD., Osaka-shi, Osaka (JP)

(72) Inventors: Ryoma Uegaki, Yokkaichi (JP); Kinji Taguchi, Yokkaichi (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/070,048

(22) PCT Filed: Dec. 2, 2016

(86) PCT No.: PCT/JP2016/085960
§ 371 (c)(1),
(2) Date: Jul. 13, 2018

(87) PCT Pub. No.: WO2017/168842
PCT Pub. Date: Oct. 5, 2017

(65) Prior Publication Data

US 2019/0027272 A1 Jan. 24, 2019

(30) Foreign Application Priority Data

Mar. 31, 2016 (JP) ..... 2016-071314

(51) Int. Cl.
*H01B 11/04* (2006.01)
*H01B 7/02* (2006.01)
(Continued)

(52) U.S. Cl.
CPC ..... *H01B 7/0216* (2013.01); *H01B 7/0291* (2013.01); *H01B 7/18* (2013.01);
(Continued)

(58) Field of Classification Search
CPC ..... H01B 11/04
(Continued)

(56) References Cited

U.S. PATENT DOCUMENTS 3,489,844 A 1/1970 Motley
3,515,796 A 6/1970 Schoerner
(Continued)

FOREIGN PATENT DOCUMENTS

CN 1716463 A 1/2006
CN 102332337 A 1/2012
(Continued)

OTHER PUBLICATIONS

Dec. 13, 2018 Office Action issued in Korean Patent Application No. 10-2018-7022375.
(Continued)

*Primary Examiner* — Chau N Nguyen
(74) *Attorney, Agent, or Firm* — Oliff PLC

(57) ABSTRACT

A communication cable that has a reduced diameter while ensuring a required magnitude of characteristic impedance. The communication cable contains a twisted pair that contains a pair of insulated wires twisted with each other and a sheath covering the twisted pair. Each of the insulated wires contains a conductor that has a tensile strength of 400 MPa or higher and an insulation coating that covers the conductor. A gap G is formed between the sheath and the insulated
(Continued)

wires constituting the twisted pair. The communication cable has a characteristic impedance of 100±10 Ω.

17 Claims, 3 Drawing Sheets

(51) Int. Cl.

| | |
|---|---|
| ***H01B 11/02*** | (2006.01) |
| ***H01B 7/18*** | (2006.01) |
| ***H01B 11/12*** | (2006.01) |
| ***H01B 11/08*** | (2006.01) |
| *H01B 11/00* | (2006.01) |
| *H01B 11/10* | (2006.01) |

(52) U.S. Cl.
CPC ..... *H01B 11/02* (2013.01); *H01B 11/08* (2013.01); *H01B 11/12* (2013.01); *H01B 11/002* (2013.01); *H01B 11/10* (2013.01)

(58) Field of Classification Search
USPC ..... 174/113 R
See application file for complete search history.

(56) References Cited

U.S. PATENT DOCUMENTS

| | | | | |
|---|---|---|---|---|
| 3,522,112 | A | 7/1970 | McLain | |
| RE27,854 | E | 12/1973 | Schoerner | |
| 4,506,235 | A | 3/1985 | Mayer | |
| 4,559,200 | A | 12/1985 | Yamasaki et al. | |
| 4,777,325 | A | 10/1988 | Siwinski | |
| 4,873,393 | A | 10/1989 | Friesen et al. | |
| 5,142,121 | A | 8/1992 | Ezaki et al. | |
| 5,283,390 | A | 2/1994 | Hubis et al. | |
| 5,327,513 | A * | 7/1994 | Nguyen | G02B 6/4403 156/55 |
| 5,399,813 | A | 3/1995 | McNeill et al. | |
| 5,424,491 | A | 6/1995 | Walling et al. | |
| 5,597,981 | A | 1/1997 | Hinoshita et al. | |
| 5,600,097 | A | 2/1997 | Bleich et al. | |
| 5,606,151 | A | 2/1997 | Siekierka et al. | |
| 5,619,016 | A | 4/1997 | Newmoyer | |
| 5,767,441 | A | 6/1998 | Brorein et al. | |
| 5,770,820 | A | 6/1998 | Nelson et al. | |
| 5,821,467 | A | 10/1998 | O'Brien et al. | |
| 6,096,977 | A | 8/2000 | Beggs et al. | |
| 6,153,826 | A | 11/2000 | Kenny et al. | |
| 6,194,663 | B1 | 2/2001 | Friesen et al. | |
| 6,211,467 | B1 | 4/2001 | Berelsman et al. | |
| 6,222,129 | B1 | 4/2001 | Siekierka et al. | |
| 6,242,097 | B1 * | 6/2001 | Nishiguchi | B32B 27/08 428/383 |
| 6,323,427 | B1 | 11/2001 | Rutledge | |
| 6,365,838 | B1 | 4/2002 | Rutledge et al. | |
| 6,555,753 | B2 | 4/2003 | Rutledge et al. | |
| 6,627,009 | B1 | 9/2003 | Matsui et al. | |
| 6,686,537 | B1 | 2/2004 | Gareis et al. | |
| 6,815,611 | B1 | 11/2004 | Gareis | |
| 7,030,321 | B2 | 4/2006 | Clark | |
| 7,214,884 | B2 | 5/2007 | Kenny et al. | |
| 7,507,909 | B2 * | 3/2009 | Federighi | H01B 11/02 174/113 R |
| 7,982,132 | B2 | 7/2011 | Hopkinson et al. | |
| 8,431,825 | B2 * | 4/2013 | Gareis | H01B 7/0823 174/113 R |
| 8,872,031 | B2 | 10/2014 | Hinoshita et al. | |
| 8,981,216 | B2 * | 3/2015 | Grant | H01B 11/06 174/113 R |
| 9,136,043 | B2 | 9/2015 | Brown et al. | |
| 9,805,844 | B2 * | 10/2017 | Bopp | H01B 11/08 |
| 10,170,220 | B2 | 1/2019 | Cornelison et al. | |
| 10,553,329 | B2 * | 2/2020 | Uegaki | H01B 7/0291 |
| 2002/0044881 | A1 | 4/2002 | Breedis et al. | |
| 2004/0112628 | A1 * | 6/2004 | Brandi | H01B 11/04 174/113 R |
| 2004/0166017 | A1 | 8/2004 | Caron et al. | |
| 2004/0238086 | A1 | 12/2004 | Saleh | |
| 2006/0124343 | A1 | 6/2006 | Clark | |
| 2006/0169479 | A1 | 8/2006 | Dillon et al. | |
| 2007/0068696 | A1 | 3/2007 | Matsui et al. | |
| 2008/0311328 | A1 | 12/2008 | Kimura | |
| 2010/0108349 | A1 | 5/2010 | Baeck et al. | |
| 2010/0200267 | A1 | 8/2010 | Baeck et al. | |
| 2011/0048764 | A1 | 3/2011 | Hira et al. | |
| 2011/0315419 | A1 | 12/2011 | Grant et al. | |
| 2012/0000690 | A1 | 1/2012 | Van Der Meer | |
| 2012/0298400 | A1 | 11/2012 | Hinoshita et al. | |
| 2013/0092437 | A1 | 4/2013 | Yoshinaga | |
| 2013/0161855 | A1 | 6/2013 | Crouse | |
| 2013/0264115 | A1 | 10/2013 | Kobayashi et al. | |
| 2013/0333936 | A1 | 12/2013 | Gundel | |
| 2014/0262424 | A1 | 9/2014 | Liptak et al. | |
| 2014/0273594 | A1 | 9/2014 | Jones et al. | |
| 2014/0353002 | A1 | 12/2014 | Placke et al. | |
| 2015/0008011 | A1 | 1/2015 | Koeppendoerfer et al. | |
| 2015/0144375 | A1 | 5/2015 | Hashimoto et al. | |
| 2015/0255928 | A1 | 9/2015 | Liptak et al. | |
| 2015/0371726 | A1 | 12/2015 | Inoue et al. | |
| 2016/0042842 | A1 | 2/2016 | Crouse | |
| 2016/0114742 | A1 | 4/2016 | Suguro et al. | |
| 2016/0133355 | A1 | 5/2016 | Glew et al. | |
| 2016/0254074 | A1 | 9/2016 | Kobayashi et al. | |
| 2016/0284437 | A1 | 9/2016 | Inoue et al. | |
| 2018/0174706 | A1 | 6/2018 | Shimosawa et al. | |

FOREIGN PATENT DOCUMENTS

| | | | |
|---|---|---|---|
| CN | 103025905 | A | 4/2013 |
| CN | 104700932 | A | 6/2015 |
| CN | 204792164 | U | 11/2015 |
| DE | 1783 163 | A1 | 7/1973 |
| EP | 1 580 767 | A2 | 9/2005 |
| EP | 3 103 122 | B1 | 7/2018 |
| JP | S61-64834 | A | 4/1986 |
| JP | H06-060740 | A | 3/1994 |
| JP | H07-57561 | A | 3/1995 |
| JP | 08-50820 | A | 2/1996 |
| JP | H08-507900 | A | 8/1996 |
| JP | H08-241631 | A | 9/1996 |
| JP | H09-92050 | A | 4/1997 |
| JP | 2001-283649 | A | 1/2001 |
| JP | 2001-148206 | A | 5/2001 |
| JP | 2002-510138 | A | 4/2002 |
| JP | 2003-36739 | A | 2/2003 |
| JP | 2005-32583 | A | 2/2005 |
| JP | 2008-130347 | A | 6/2008 |
| JP | 2011-96505 | A | 5/2011 |
| JP | 2012-109128 | A | 6/2012 |
| JP | 2012-146431 | A | 8/2012 |
| JP | 2013-098127 | A | 5/2013 |
| JP | 2015-86452 | A | 5/2015 |
| JP | 2015-130326 | A | 7/2015 |
| JP | 2015-170431 | A | 9/2015 |
| JP | 2016-157668 | A | 9/2016 |
| KR | 100708417 | B1 | 4/2007 |
| KR | 100825408 | B1 | 4/2008 |
| KR | 20140142671 | A | 12/2014 |
| WO | 99/50855 | A1 | 10/1999 |
| WO | 2000074079 | A1 | 12/2000 |
| WO | 2008/127579 | A1 | 10/2008 |
| WO | 2015093317 | A1 | 6/2015 |

OTHER PUBLICATIONS

Nov. 13, 2018 Japanese Office Action issued in Japanese Patent Application No. 2018-508394.
Jun. 1, 2018 Office Action issued in U.S. Appl. No. 15/565,526.
Oct. 22, 2018 Office Action issued in U.S. Appl. No. 15/565,526.
Blattenberger; "Dielectric Constant, Strength, & Loss Tangent"; http://www.rfcafe.com/references/electrical/dielectric-constants-strengths.htm; Oct. 15, 2008.

(56) References Cited

OTHER PUBLICATIONS

Lapointe; "Electrical Properties of Plastics"; http://users.tm.net/lapointe/Plastics.htm; Sep. 28, 2001.
Nov. 14, 2018 Office Action issued in U.S. Appl. No. 16/070,057.
U.S. Appl. No. 16/070,057, filed Jul. 13, 2018 in the name of Ryoma Uegaki et al.
Dec. 13, 2016 International Search Report issued in International Patent Application No. PCT/JP2016/082789.
Dec. 27, 2016 International Search Report issued in International Patent Application No. PCT/JP2016/085960.
May 28, 2019 Office Action issued in Chinese Patent Application No. 201680083363.3.
Mar. 12, 2019 Office Action issued in corresponding Chinese Patent Application No. 201680082773.6.
Apr. 15, 2019 German Office Action issued in German Patent Application No. 11 2016 006 142.0.
May 20, 2019 Office Action issued in Chinese Patent Application No. 201680083365.2.
Mar. 21, 2019 Office Action issued in U.S. Appl. No. 15/565,526.
Aug. 13, 2019 Office Action issued in Chinese Application No. 201680082773.6.
Jun. 28, 2019 Office Action issued in U.S. Appl. No. 15/565,526.
Dec. 10, 2019 Office Action issued in Chinese Patent Application No. 201680083363.3.
Oct. 22, 2019 Office Action issued in Chinese Patent Application No. 201680083365.2.
Nov. 29, 2019 Office Action issued in Korean Patent Application No. KR 10-2019-7019783.
Jan. 17, 2020 Office Action issued in U.S. Appl. No. 16/511,340.
Jan. 7, 2020 Office Action issued in Japanese Patent Application No. 2018-558063.
Jan. 7, 2020 Office Action issued in Japanese Patent Application No. 2018-566086.
Mar. 3, 2020 Office Action issued in Chinese Patent Application No. 201780075209.6.
Mar. 10, 2020 Office Action issued in Chinese Patent Application No. 201880007236.4.
Mar. 6, 2020 Office Action issued in U.S. Appl. No. 16/480,387.
Mar. 20, 2020 Office Action issued in Chinese Application No. 201680083363.3.
Mar. 31, 2020 Office Action issued in Japanese Application No. 2018-558063.
May 6, 2020 Office Action issued in U.S. Appl. No. 16/716,146.
Druflon International PTFE Insulated Equipment Wire Physical Data (Year:2004).
Druflon International Table of Sizes for PTFE Insulated Wires (Year: 2004).
Jun. 26, 2020 Office Action issued in U.S. Appl. No. 16/472,304.

* cited by examiner

COMMUNICATION CABLE

TECHNICAL FIELD

The present invention relates to a communication cable, and more specifically to a communication cable that can be used for high-speed communication such as in an automobile.

BACKGROUND ART

Demand for high-speed communication is increasing in fields such as of automobiles. Transmission characteristics of a cable used for high-speed communication such as a characteristic impedance thereof have to be controlled strictly. For example, a characteristic impedance of a cable used for Ethernet communication has to be controlled to be 100±10 Ω.

A characteristic impedance of a communication cable depends on specific features thereof such as a diameter of a conductor and type and thickness of an insulation coating. For example, Patent Document 1 discloses a shielded communication cable containing a twisted pair that contains a pair of insulated cores twisted with each other, each insulated core containing a conductor and an insulator covering the conductor. The cable further contains a metal-foil shield covering the twisted pair, a grounding wire electrically continuous with the shield, and a sheath that covers the twisted pair, the grounding wire, and the shield together. The cable has a characteristic impedance of 100±10 Ω. The insulated cores used in Patent Document 1 have a conductor diameter of 0.55 mm, and the insulator covering the conductor has a thickness of 0.35 to 0.45 mm.

CITATION LIST

Patent Literature

Patent Document 1: JP 2005-32583 A

SUMMARY OF INVENTION

Technical Problem

There exists a great demand for reduction of a diameter of a communication cable installed such as in an automobile. To satisfy the demand, the size of the cable has to be reduced with satisfying required transmission characteristics including characteristic impedance. A possible method for reducing the diameter of a communication cable containing a twisted pair is to make insulation coatings of insulated wires constituting the twisted pair thinner. According to investigation by the present inventors, however, if the thickness of the insulator in the communication cable disclosed in Patent Document 1 is made smaller than 0.35 mm, the characteristic impedance falls below 90 Ω. This is out of the range of 100±10 Ω, which is required for Ethernet communication.

An object of the present invention is to provide a communication cable that has a reduced diameter while ensuring a required magnitude of characteristic impedance.

Solution to Problem

To achieve the object and in accordance with the purpose of the present invention, a communication cable according to the present invention contains a twisted pair containing a pair of insulated wires twisted with each other. Each of the insulated wire contains a conductor that has a tensile strength of 400 MPa or higher and an insulation coating that covers the conductor. The communication cable contains a sheath that is made of an insulating material and covers the twisted pair, and a gap between the sheath and the insulated wires constituting the twisted pair.

It is preferable that each of the insulated wires has a conductor cross-sectional area smaller than 0.22 $mm^2$. It is preferable that the insulation coating of each of the insulated wires has a thickness of 0.30 mm or smaller. It is preferable that each of the insulated wires has an outer diameter of 1.05 mm or smaller. It is preferable that the conductor of each of the insulated wires has a breaking elongation of 7% or higher.

It is preferable that the gap occupies 8% or more of an area of a region surrounded by an outer surface of the sheath in a section of the communication cable crossing an axis of the cable. It is preferable that the gap occupies 30% or less of an area of a region surrounded by an outer surface of the sheath in a section of the communication cable crossing an axis of the cable. It is preferable that the twisted pair has a twist pitch of 45 times of an outer diameter of each of the insulated wires or smaller. It is preferable that the sheath has an adhesion strength of 4 N or higher to the insulated wires.

Advantageous Effects of Invention

In the above-described communication cable, since the conductor of each of the insulated wires constituting the twisted pair has the high tensile strength of 400 MPa or higher, the diameter of the conductor can be reduced while sufficient strength required for an electric wire is ensured. Thus, the distance between the two conductors constituting the twisted pair is reduced, whereby the characteristic impedance of the communication cable can be increased. As a result, the characteristic impedance of the communication cable can be ensured in the range of 100±10 Ω, without falling below the range, even when the insulation coating of each of the insulated wires is made thin to reduce the diameter of the communication cable.

Further, the communication cable contains the gap between the sheath covering the twisted pair and the insulated wires constituting the twisted pair, and a layer of air exists around the twisted pair, whereby the characteristic impedance of the communication cable can be higher than in the case where the sheath fills the gap. Thus, a sufficiently high characteristic impedance can be ensured well for the communication cable even when the thickness of the insulation coating of each of the insulated wires is reduced. Reduction of the thickness of the insulation coating would lead to reduction of the entire outer diameter of the communication cable.

When each of the insulated wires has the conductor cross-sectional area smaller than 0.22 $mm^2$, the characteristic impedance of the communication cable is increased due to the effect of reduction of the distance between the two insulated wires constituting the twisted pair, whereby reduction of the diameter of the communication cable by reduction of the thickness of the insulation coating is facilitated while ensuring the required characteristic impedance. Further, the small diameter of each of the conductor itself has the effect of reducing the diameter of the communication cable.

When the insulation coating of each of the insulated wires has the thickness of 0.30 mm or smaller, the diameter of each of the insulated wires is sufficiently small, whereby the diameter of the whole communication cable can effectively be made small.

Also when each of the insulated wires has the outer diameter of 1.05 mm or smaller, the diameter of the entire communication cable can effectively be made small.

When the conductor of each of the insulated wires has the breaking elongation of 7% or higher, the conductor has a high impact resistance, whereby the conductor well resists the impact applied to the conductor when the communication cable is processed into a wiring harness or when the wiring harness is installed.

When the gap occupies 8% or more of the area of the region surrounded by the outer surface of the sheath in the section of the communication cable crossing the axis of the cable, the diameter of the communication cable is more effectively reduced by increase of the characteristic impedance thereof.

When the gap occupies 30% or less of the area of the region surrounded by the outer surface of the sheath in the section of the communication cable crossing the axis of the cable, the gap is not too large to fix the position of the twisted pair steadily in the space inside the sheath. Thus, fluctuations or temporal changes in transmission characteristics of the communication cable including the characteristic impedance are suppressed well.

When the twisted pair has the twist pitch of 45 times of the outer diameter of each of the insulated wires or smaller, the twist structure of the twisted pair is hard to be loosened, whereby fluctuations or temporal changes in the transmission characteristics of the communication cable including the characteristic impedance that can be caused by loosening of the twist structure are suppressed well.

When the sheath has the adhesion strength of 4 N or higher to the insulated wires, variation in the position of the twisted pair inside the sheath or loosening of the twist structure thereof hardly occurs. Thus, fluctuations or temporal changes in transmission characteristics of the communication cable including the characteristic impedance that may be caused by the variation or loosening are suppressed well.

BRIEF DESCRIPTION OF DRAWINGS

FIG. 3A shows a first twist structure (without wrenching) while FIG. 3B shows a second twist structure (with wrenching). In each figure, a dotted line serves as a guide to show portions along the axis of an insulated wire that are located in an identical position with respect to the axis of the insulated wire.

DESCRIPTION OF EMBODIMENTS

A detailed description of a communication cable according to a preferred embodiment of the present invention will now be provided.

[Configuration of Communication Cable]

Figure 1:
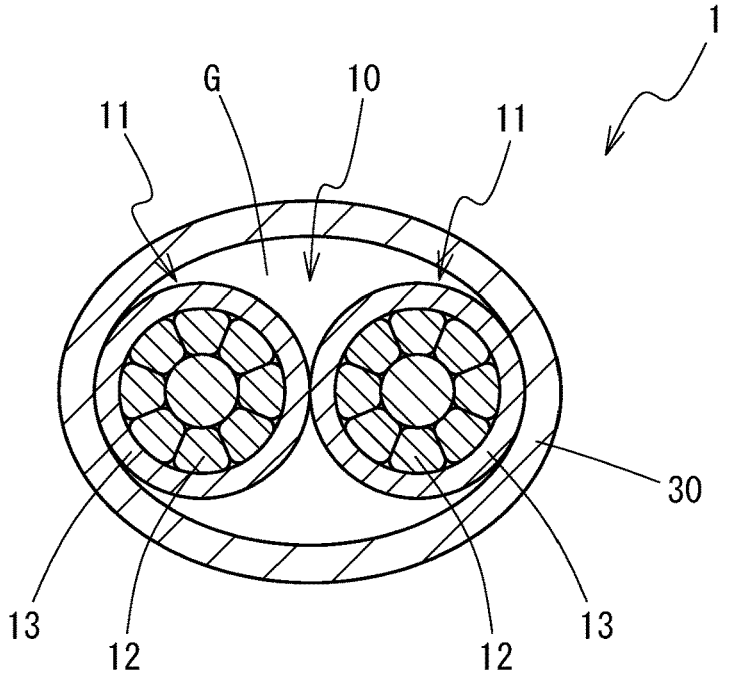
FIG. 1 is a cross-sectional view showing a communication cable according to a preferred embodiment of the present invention that has a sheath taking the form of a loose jacket.

FIG. 1 shows a cross-sectional view of the communication cable 1 according to the embodiment of the present invention.

The communication cable 1 contains a twisted pair 10 that contains a pair of insulated wires 11, 11 twisted with each other. Each of the insulated wires 11 contains a conductor 12 and an insulation coating 13 that covers the conductor 12 on the outer surface of the conductor 12. Further, the communication cable 1 contains a sheath 30 that is made of an insulating material and covers the whole twisted pair 10 on the outer periphery of the twisted pair 10.

The communication cable 1 has a characteristic impedance of 100±10 Ω. A characteristic impedance of 100±10 Ω is required for a cable used for Ethernet communication. Having the characteristic impedance, the communication cable 1 can be used suitably for high-speed communication such as in an automobile.

(1) Configuration of Insulated Wires

The conductors 12 of the insulated wires 11 constituting the twisted pair 10 are metal wires having a tensile strength of 400 MPa or higher. Specific examples of the metal wires include copper alloy wires containing Fe and Ti and copper alloy wires containing Fe, P, and Sn, which are illustrated later. The tensile strength of the conductors 12 is preferably 440 MPa or higher, and more preferably 480 MPa or higher.

Since the conductors 12 have the tensile strength of 400 MPa or higher, 440 MPa or higher, or 480 MPa or higher, the conductors can maintain a tensile strength that is required for electric wires even when the diameter of the conductors 12 is reduced. When the diameter of the conductors 12 is reduced, the distance between the two conductors 12, 12 constituting the twisted pair 10 (i.e., the length of the line connecting the centers of the conductors 12, 12 with each other) is reduced, whereby the characteristic impedance of the communication cable 1 is increased. For example, the diameter of the conductors 12 can be as small as providing a conductor cross-sectional area smaller than 0.22 $mm^2$, and more preferably a conductor cross-sectional area of 0.15 $mm^2$ or smaller, or 0.13 $mm^2$ or smaller. The outer diameter of the conductors 12 can be 0.55 mm or smaller, more preferably 0.50 mm or smaller, and still more preferably 0.45 mm or smaller. If the diameter of the conductors 12 is too small, however, the conductors 12 can hardly have sufficient strength, and the characteristic impedance of the communication cable 1 may be too high. Thus, the conductor cross-sectional area of the conductors 12 is preferably 0.08 $mm^2$ or larger.

When the conductors 12 have a small conductor cross-sectional area smaller than 0.22 $mm^2$, characteristic impedance of 100±10 Ω can be ensured well for the communication cable 1 even if the thickness of the insulation coatings 13 covering the conductors 12 are reduced, for example, to 0.30 mm or smaller. Conventional copper electric wires are hard to be used with a conductor cross-sectional area smaller than 0.22 $mm^2$ because the wires have lower tensile strengths.

It is preferable that the conductors 12 should have a breaking elongation of 7% or higher. Generally, a conductor having a high tensile strength has low toughness, and thus exhibits low impact resistance when a force is applied to the conductor rapidly. If the above-described conductors 12 having the high tensile strength of 400 MPa or higher have a breaking elongation of 7% or higher, however, the conductors 12 can exhibit excellent resistance to impacts applied to the conductors 12 when the communication cable 1 is processed to a wiring harness or when the wiring harness is installed. The breaking elongation of the conductors 12 is more preferably 10% or higher.

The conductors 12 may each consist of single wires; however, it is preferable in view of having high flexibility that the conductors 12 should consist of strand wires each containing a plurality of elemental wires stranded with each other. In this case, the conductors 12 may be compressed strands formed by compression of strand wires after stranding of the elemental wires. The outer dimeter of the conductors 12 can be reduced by the compression. Further, when the conductors 12 are strand wires, the conductors 12 may consist of single type of elemental wires or of two or more types of elemental wires as long as the whole conductors 12 each have the tensile strength of 400 MPa or higher. Example of the conductors 12 consisting of two or more types of elemental wires include conductors that contain below-described copper alloy wires containing Fe and Ti, or ones containing Fe, P, and Sn, and further contain elemental wires made of a metal material other than a copper alloy such as SUS.

The insulation coatings 13 of the insulated wires 11 may be made of any kind of polymer material. It is preferable that the insulation coatings 13 should have a relative dielectric constant of 4.0 or smaller in view of ensuring the required high characteristic impedance. Examples of the polymer material having the relative dielectric constant include polyolefin such as polyethylene and polypropylene, polyvinyl chloride, polystyrene, polytetrafluoroethylene, and polyphenylenesulfide. Further, the insulation coatings 13 may contain additives such as a flame retardant in addition to the polymer material.

The characteristic impedance of the communication cable 1 is increased by reduction of the diameter of the conductors 12 and consequent closer location of the two conductors 12, 12. As a result, the thickness of the insulation coatings 13 that is required to ensure the required characteristic impedance can be reduced. For example, the thickness of the insulation coatings 13 is preferably 0.30 mm or smaller, more preferably 0.25 mm or smaller, and still more preferably 0.20 mm or smaller. If the insulation coatings 13 are too thin, however, it may be hard to ensure the required high characteristic impedance. Thus, the thickness of the insulation coatings 13 is preferably larger than 0.15 mm.

The whole diameter of the insulated wires 11 is reduced by reduction of the diameter of the conductors 12 and the thickness of the insulation coatings 13. For example, the outer dimeter of the insulated wires 11 can be 1.05 mm or smaller, more preferably 0.95 mm or smaller, and still more preferably 0.85 mm or smaller. Reduction of the diameter of the insulated wires 11 serves to reduce the diameter of the communication cable 1 as a whole.

In the insulated wires 11, it is preferable that the uniformity in the thickness of the insulation coatings 13 (i.e., the insulation thickness) around the conductors 12 should be higher. In other words, it is preferable that thickness deviation of the insulation coatings 13 should be smaller. In that case, eccentricity of the conductors 12 would be smaller, and thus the symmetry of the positions of conductors 12 within the twisted pair 10 would be higher. As a result, the communication cable 1 would have higher transmission characteristics, and more particularly higher mode conversion characteristics. For example, it is preferable that the eccentricity ratio of the insulated wires 11 should be 65% or higher, and more preferably 75% or higher. Here, the eccentricity ratio is calculated as [smallest insulation thickness]/[largest insulation thickness]×100%.

(2) Twist Structure of Twisted pair

The twisted pair 10 may be formed by twisting of the two insulated wires 11 with each other. The twist pitch may be set appropriately depending such as on the outer diameter of the insulated wires 11; however, the twist pitch is preferably 60 times of the outer diameters of the insulated wires 11 or smaller, more preferably 45 times or smaller, and still more preferably 30 times or smaller, to effectively suppress loosening of the twist structure. Loosening of the twist structure may lead to fluctuations or temporal changes in transmission characteristics of the communication cable 1 including the characteristic impedance. In particular, when the sheath 30 takes the form of a loose jacket as described below, the sheath 30 may be more difficult to suppress loosening of the twist structure caused by force applied to the twisted pair 10 than in the case where the sheath 30 takes the form of a filled jacket since there exists a gap G between the loose jacket sheath 30 and the twisted pair 10. Loosening of the twist structure, however, can be effectively suppressed by adopting the above-described preferable twist pitch even when the sheath 30 takes the form of the loose jacket. By suppression of the loosening of the twist structure, the distance (i.e., line spacing) between the two insulated wires 11 constituting the twisted pair 10 can be kept small, for example, substantially at 0 mm in every portion within the pitch, whereby stable transmission characteristics can be achieved. On the other hand, if the twist pitch of the twisted pair 10 is too small, the productivity of the twisted pair 10 may be low, and production cost of the twisted pair 10 may be high. Thus, the twist pitch is preferably 8 times of the outer diameter of the insulated wires 11 or larger, more preferably 12 times or larger, and still more preferably 15 times or larger.

Figure 3A:
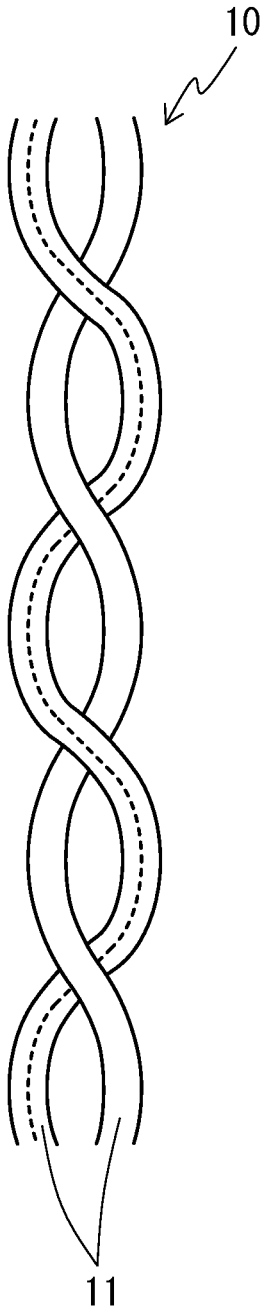
FIGS. 3A and 3B are explanatory drawings showing two types of twist structures.

Examples of the twist structure of the two insulated wires 11 in the twisted pair 10 include the two following structures: in a first twist structure, as shown in FIG. 3A, each of the insulated wires 11 is not wrenched about its twist axis, and portions of each of the insulated wires 11 with respect to its own axis do not change their relative up-down or left-right orientations along the twist axis. In other words, portions located in an identical position with respect to the axis of each of the insulated wires 11 face one direction, such as an upward direction, throughout the twist structure. In the figure, the dotted line shows portions along the axis of one of the insulated wires 11 that are located in an identical position with respect to the axis of the insulated wire 11. Since the insulated wire 11 is not wrenched, the dotted line is visible on the front side of the figure, at the center of the wire 11, throughout the twist structure. It should be noted that FIGS. 3A and 3B show the twisted pair 10 in a state where the twist is loosened for easier recognition of the twist structure.

Figure 3B:
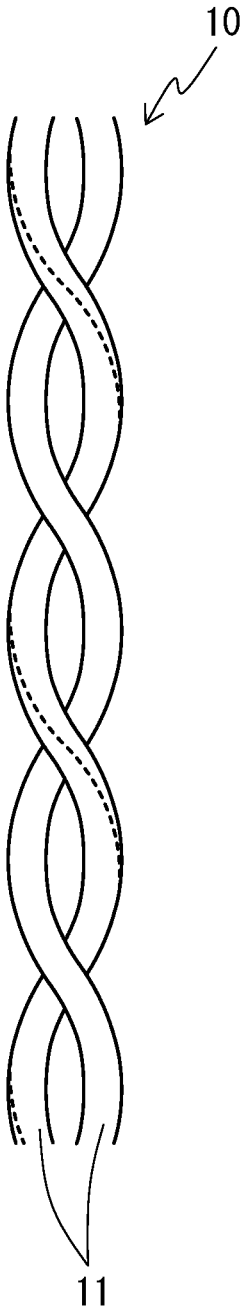

In a second twist structure, as shown in FIG. 3B, each of the insulated wires 11 is wrenched about its twist axis, and portions of each of the insulated wires 11 with respect to its own axis change their relative up-down and left-right orientations along the twist axis. In other words, portions located in an identical position with respect to the axis of each of the insulated wires 11 face various directions, such as upward, downward, leftward, and rightward, throughout the twist structure. In the figure, the dotted line shows portions along the axis of one of the insulated wires 11 that are located in an identical position with respect to the axis of the insulated wire 11. Since the insulated wire 11 is wrenched, the dotted line is visible on the front side of the figure only in a part of every pitch of the twist structure. The dotted line continuously changes its position in the front and back direction in every pitch of the twist structure.

The first twist structure is more preferable than the second one. This is because variation in the line spacing between the two insulated wires 11 in every pitch is smaller in the first twist structure. Particularly, in the communication cable 1 according to the present embodiment, variation in the line spacing may occur easily due to the influence of the wrenching of the insulated wires 11 since the insulated wires 11 have a reduce diameter; however, the influence of the wrenching can be suppressed better in the first twist structure. Variation in the line spacing may destabilize the transmission characteristics of the communication cable 1.

It is preferable that the difference between the lengths of the two insulted wires 11 constituting the twisted pair 10 (i.e., line length difference) should be smaller. In that case, the symmetry of the two insulated wires 11 in the twisted pair 10 can be higher, and thus the transmission characteristics of the twisted pair 10, and more particularly its mode conversion characteristics, can be improved. For example, when the line length difference in 1 m of the twisted pair 10 is 5 mm or smaller, and more preferably 3 mm or smaller, the influence of the line length difference can be suppressed well.

(3) Summarized Configuration of Sheath

The sheath 30 plays roles of protecting the twisted pair 10 and maintaining the twist structure of the twisted pair 10. In the embodiment shown in FIG. 1, the sheath 30 takes the form of a loose jacket. The loose jacket takes the shape of a hollow tube, and accommodates the twisted pair 10 in the space inside the hollow tube. Sheath 30 is in contact with the insulated wires 11 constituting the twisted pair 10 in some portions along the peripheral direction of the inner surface of the sheaths 30 while a gap G exists between the sheath 30 and the insulated wires 11 in the other portions. There is a layer of air in the gap G. Details of the configuration of the sheath 30 will be illustrated later.

For evaluation of the state of the communication cable 1 in the cross section thereof with regard to, for example, whether there is a gap G between the sheath 30 and the insulated wires 11 or how large the gap G is, as stated below, it is preferable that the whole communication cable 1 should be embedded in a resin such as an acrylic resin, and is fixed in the resin in a state where the space inside the sheath 30 is filled with the resin. Then, the cable 1 should be cut. In this procedure, the cutting operation to obtain the cross section hardly impairs the precision of the evaluation by deforming the sheath 30 or the twisted pair 10. In the obtained cross section, an area filled with the resin corresponds to an area where a gap G originally occupied.

In the communication cable 1 according to the present embodiment, the sheath 30 directly surrounds the twisted pair 10, without having a shield made of a conductive material surrounding the twisted pair 10 inside the sheath 30, in contrast to the case disclosed in Patent Document 1. The shield would play roles of shielding the twisted pair 10 from outside noises and stopping noises released from the twisted pair 10 to the outside; however, the communication cable 1 according to the present embodiment does not have the shield because the cable 1 is expected to be used under conditions where the influence of noises is not serious. It is preferable that the communication cable 1 according to the present embodiment should not have the shield or any other member between the sheath 30 and the twisted pair 10 in view of effectively achieving reduction of the diameter and cost of the cable 1 by simplification of its configuration, but the sheath 30 should directly surround the twisted pair 10 via the gap G.

(4) Characteristics of Whole Communication Cable

As described above, since the conductors 12 of the insulated wires 11 constituting the twisted pair 10 of the communication cable 1 have a tensile strength of 400 MPa or higher, sufficient strength for the use in an automobile can be ensured well for the communication cable 1 even when the diameter of the conductors 12 is reduced. When the conductors 12 have a reduced diameter, the distance between the two conductors 12, 12 in the twisted pair 10 is reduced. When the distance between the two conductors 12, 12 is reduced, the characteristic impedance of the communication cable 1 is increased. When the insulated wires 11 constituting the twisted pair 10 have thinner insulation coatings 13, the communication cable 1 has a lower characteristic impedance; however, in the present embodiment, the reduced distance between the conductors 12, 12 realized by their reduced diameter can ensure the characteristic impedance of 100±10 Ω for the communication cable 1 even with a small thickness of the insulation coatings 13, for example, of 0.30 mm or smaller.

Making the insulation coatings 13 of the insulated wires 11 thinner leads to reduction of the diameter (i.e. finished diameter) of the communication cable 1 as a whole. For example, the diameter of the communication cable 1 can be reduced to 2.9 mm or smaller, and more preferably to 2.5 mm or smaller. The communication cable 1, having the reduced diameter while ensuring the required characteristic impedance, can be suitably used for high-speed communication in a limited space such as in an automobile.

Reduction of the diameter of the conductors 12 and the thickness of the insulation coatings 13 in the insulated wires 11 is effective for reduction of the weight of the communication cable 1 as well as reduction of the diameter of the cable 1. When the cable 1 is used for communication in an automobile, reduction of the weight of the communication cable 1 leads to reduction of the weight of the whole automobile and thereby to improvement of fuel efficiency of the automobile.

Further, the communication cable 1 has a high breaking strength since the conductors 12 contained in the insulated wires 11 have the tensile strength of 400 MPa or higher. The breaking strength can be increased, for example, to 100 N or higher, and more preferably to 140 N or higher. Having the high breaking strength, the communication cable 1 can exhibit a high holding strength at a terminal end thereof with respect to a component such as a terminal fitting. In other words, the communication cable 1 hardly breaks at a terminal position thereof where a component such as a terminal fitting is attached.

It is more preferable that a communication cable should have transmission characteristics, such as transmission loss (IL), reflection loss (RL), transmission mode conversion (LCTL), and reflection mode conversion (LCL), that satisfy required levels, as well as a sufficiently high characteristic impedance such as 100±10 Ω. Particularly, the communication cable 1 according to the present embodiment can satisfy the criteria IL≤0.68 dB/m (66 MHz), RL≥20.0 dB (20 MHz), LCTL≥46.0 dB (50 MHz), and LCL≥46.0 dB (50 MHz) even when the thickness of the insulation coatings 13 of the insulated wires 11 is smaller than 0.25 mm and is further 0.15 mm or smeller since the sheath 30 takes the form of the loose jacket.

[Detailed Configuration of Sheath]

Figure 2:
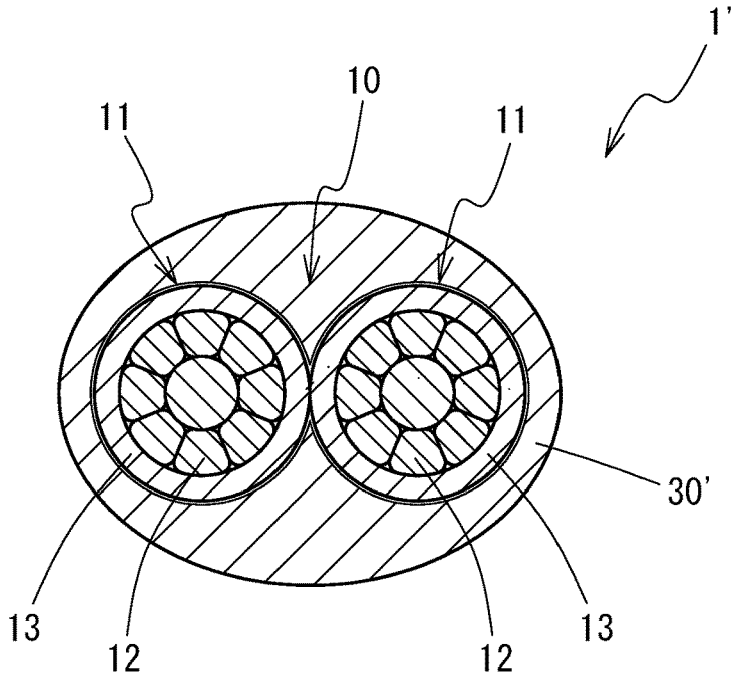
FIG. 2 is a cross-sectional view showing a communication cable that has a sheath taking the form of a filled jacket.

As described above, in the present embodiment, the communication cable 1 has a sheath 30 taking the form of a loose jacket, and has a gap G between the sheath 30 and the insulated wires 11 constituting the twisted pair 10. Meanwhile, a communication cable 1' that has a sheath 30' taking the form of a filled jacket is also available, as shown in FIG. 2. In this case, the sheath 30' is in contact with the insulated wires 11 constituting the twisted pair 10, or fills the space extending to close proximity of the insulated wires 11. The cable 1' has substantially no gap between the sheath 30' and the insulated wires 11 except a gap inevitably formed in the manufacturing process.

The sheath 30 takes more preferably the form of the loose jacket than the form of the filled jacket in view of reduction of the diameter of the communication cable 1 while ensuring the characteristic impedance at a required high level. This is because the characteristic impedance of the communication cable 1 is higher when the twisted pair 10 is surrounded by a material having a smaller dielectric constant (see Formula (1) below). The loose jacket configuration where a layer of air surrounds the twisted pair 10 provides a higher characteristic impedance than the filled jacket configuration where a dielectric material exists immediately outside the twisted pair 10. Thus, the loose jacket configuration can ensure the characteristic impedance of 100±10 Ω with thinner insulation coatings 13 of the insulated wires 11 than the filled jacket configuration. The thinner insulation coatings 13 contribute to reduction of the dimeter of the insulated wires 11 and that of the whole communication cable 1.

Specifically, when the conductors 12 of the insulated wires 11 have a tensile strength of 400 MPa or higher and the sheath 30 takes the form of the loose jacket, a characteristic impedance of 100±10 Ω can be ensured for the communication cable 1 even if the thickness of the insulation coatings 13 of the insulated wires 11 is smaller than 0.25 mm, or further is 0.20 mm or smaller. In this case, the outer diameter of the whole communication cable 1 can be 2.5 mm or smaller.

Further, the communication cable 1 having the loose jacket sheath 30 is lighter in weight per unit length than the filled jacket sheath since the loose jacket configuration requires a smaller amount of material. Weight reduction of the sheath 30 by adopting the loose jacket configuration, together with above-described reduction of the diameter of the conductors 12 and the thickness of the insulation coatings 13, contributes to reduction of weight of the communication cable 1 as a whole and improvement of fuel efficiency of an automobile in which the cable 1 is installed.

Though the communication cable 1 having the loose jacket sheath 30 may be sensitive to the influence of unintended flection or bending due to the hollow cylinder shape of the sheath 30, the influence is mitigated by the use of the conductors 12 having the tensile strength of 400 MPa or higher.

When there exists a larger gap G between the sheath 30 and the insulated wires 11, the communication cable 1 has a smaller effective dielectric constant (see Formula (1) below), and thus a higher characteristic impedance. When the ratio of the area that the gap G occupies (hereafter called outer area ratio) is 8% or more in a cross section of the communication cable 1 substantially orthogonal to the axis of the cable 1 with respect to the total area of the region surrounded by the outer surface of the sheath 30 or, in other words, with respect to the cross-sectional area of the cable 1 including the thickness of the sheath 30, the characteristic impedance of 100±10 Ω can be ensured well. This is because a layer of sufficient amount of air exists around the twisted pair 10. The outer area ratio of the gap G is more preferably 15% or more. On the other hand, if the ratio of the area that gap G occupies is too large, positional displacement of the twisted pair 10 inside the sheath 30 and loosening of the twist structure of the twisted pair 10 may occur easily. Those phenomena may lead to fluctuations or temporal changes in transmission characteristics of the communication cable 1 including the characteristic impedance. In view of suppressing the fluctuations and temporal changes, the outer area ratio of the gap G is preferably 30% or less, and more preferably 23% or less.

An index that can be used to define the ratio of the gap G instead of the above-described outer area ratio may be the ratio of the area that the gap G occupies (hereafter called inner area ratio) in the cross section of the communication cable 1 substantially orthogonal to the axis of the cable 1 with respect to the total area of the region surrounded by the inner surface of the sheath 30 or, in other words, with respect to the cross-sectional area of the cable 1 excluding the thickness of the sheath 30. For the same reasons described above for the outer area ratio, the inner area ratio of the gap G is preferably 26% or more, and more preferably 39% or more while it is preferably 56% or less, and more preferably 50% or less. The outer area ratio is more preferable than the inner area ratio to be used as an index to define the size of the gap G for ensuring the sufficient characteristic impedance because the thickness of the sheath 30 has influence on the effective dielectric constant and characteristic impedance of the communication cable 1. Nevertheless, the inner area ratio may also be a good index particularly when the sheath 30 is so thick that the thickness of the sheath 30 has only small influence on the characteristic impedance of the communication cable 1.

The ratio of the gap G in the cross section of the communication cable 1 may be different depending on the position within one pitch of the twisted pair 10. In such a case, it is preferable that the outer or inner area ratio of the gap G should fall in the above-described preferable range on an average over the length corresponding to one pitch of the twisted pair 10, and it is more preferable that the ratio should fall in the range everywhere over the length corresponding to the one pitch. Alternatively, the ratio of the gap Gin this case may be evaluated based on the volume of the gap G in the length corresponding to the one pitch of the twisted pair 10. Specifically, the ratio of the volume that the gap G occupies (hereafter called outer volume ratio) with respect to the volume of the region surrounded by the outer surface of the sheath 30 in the length corresponding to the one pitch of the twisted pair 10 is preferably 7% or more, and more preferably 14% or more. On the other hand, the outer volume ratio is preferably 29% or less, and more preferably 22% or less. Further alternatively, the ratio of the volume that the gap G occupies (hereafter called inner volume ratio) with respect to the volume of the region surrounded by the inner surface of the sheath 30 in the length corresponding to the one pitch of the twisted pair 10 is preferably 25% or more, and more preferably 38% or more. On the other hand, the inner volume ratio is preferably 55% or less, and more preferably 49% or less.

Further, when there exists a larger gap G between the sheath 30 and the insulated wires 11, the effective dielectric constant represented by Formula (1) below is smaller, as described above. The effective dielectric constant depends on the size of the gap G as well as on other parameters such as the type of the material of the sheath 30 and the thickness of the sheath 30. When the size of the gap G and the other parameters are set so as to provide the effective dielectric constant of 7.0 or smaller, and more preferably 6.0 or smaller, the characteristic impedance of the communication cable 1 can effectively be increased to as high as 100±10 Ω. On the other hand, the effective dielectric constant is preferably 1.5 or larger, and more preferably 2.0 or larger in view of providing manufacturability and reliability of the communication cable 1 and ensuring a certain or larger thickness for insulation coatings 13. The size of the gap G may be controlled by conditions on formation of the sheath 30 by extrusion molding (such as shapes of die and point and extrusion temperature).

[Formula 1]

$$Z_0 = \frac{\eta_0}{\pi\sqrt{\varepsilon_{eff}}}\cosh^{-1}\left(\frac{D}{d}\right), \quad (1)$$

where $\varepsilon_{eff}$ is an effective dielectric constant, d is a diameter of conductors, D is an outer diameter of the cable, and $\eta_0$ is a constant.

As shown in FIG. 1, some portions of the inner surface of the sheath 30 are in contact with the insulated wires 11. If the sheath 30 is strongly adhered to the insulated wires 11 in the portions, the sheath 30 can suppress phenomena such as positional displacement of the twisted pair 10 inside the sheath 30 and loosening of twist structure of the twisted pair 10 by holding the twisted pair 10 fast. The adhesion strength of the sheath 30 to the insulated wires 11 is preferably 4 N or higher, more preferably 7 N or higher, and still more preferably 8 N or higher. Consequently, those phenomena can be suppressed effectively. Further, the line spacing between the two insulated wires 11 can be maintained at a small value, such as substantially 0 mm, and thus fluctuations or temporal changes in transmission characteristics including the characteristic impedance can effectively be suppressed. On the other hand, the adhesion strength is preferably 70 N or lower because if the adhesion strength of the sheath 30 is too high, the processibility of the communication cable 1 may be low. The adhesion of the sheath 30 to the insulated wires 11 may be adjusted depending on the extrusion temperature of a resin material that is extruded around the twisted pair 10 to form the sheath 30. The adhesion strength may be evaluated, for example, by a test in which a 30-mm long portion of the sheath 30 is removed from a terminal end of the communication cable 1 having a length of 150 mm, and then the twisted pair 10 is pulled. The strength of pulling when the twisted pair 10 falls out can be regarded as the adhesion strength.

Further, when the area in which the inner surface of the sheath 30 is in contact with the insulated wires 11 is larger, the phenomena are suppressed better such as positional displacement of the twisted pair 10 inside the sheath 30 and loosening of the twist structure of the twisted pair 10. The phenomena are effectively suppressed when the ratio of the length of portions where the sheath 30 is in contact with the insulated wires 11 (hereafter called contact ratio) with respect to the total length of an inner perimeter of the sheath 30 in the cross section of the communication cable 1 substantially orthogonal to the axis of the cable 1 is preferably 0.5% or more, and more preferably 2.5% or more. On the other hand, the gap G can be surely formed when the contact ratio is 80% or less, and more preferably 50% or less. It is preferable that the contact ratio should fall in the above-described preferable range on an average over the length corresponding to the one pitch of the twisted pair 10, and it is more preferable that the contact ratio should fall in the range everywhere over the length corresponding to the one pitch.

The thickness of the sheath 30 may be set appropriately. For example, the thickness may be 0.20 mm or larger, and more preferably 0.30 mm or larger in view of reducing the influence of noises from outside of the communication cable 1, such as from other cables constituting a wiring harness together with the communication cable 1, and in view of ensuring mechanical properties of the sheath 30 such as wear resistance and impact resistance. On the other hand, the thickness of the sheath 30 maybe 1.0 mm or smaller, and more preferably 0.7 mm or smaller, in view of providing a small effective dielectric constant and reducing the diameter of the whole communication cable 1.

Though the loose jacket sheath 30 is more preferable in view of reduction of the diameter of the communication cable 1 as described hitherto, the filled jacket sheath 30' shown in FIG. 2, for example, may be used when reduction of the diameter of the cable 1 is not so highly required. The filled jacket sheath 30' fixes the twisted pair 10 more steadily and suppresses the phenomena better, such as positional displacement of the twisted pair 10 with respect to the sheath 30' and loosening of the twist structure of the twisted pair 10. As a result, fluctuations or temporal changes in transmission characteristics of the communication cable 1 including the characteristic impedance caused by those phenomena are suppressed better. It may be controlled by conditions on formation of the sheath 30/30' by extrusion molding (such as shapes of die and point and extrusion temperature) whether the loose jacket sheath 30 or the filled jacket sheath 30' is formed. It is not mandatory for the communication cable 1 to have a sheath 30, but the sheath 30 may be omitted when no problem is caused by the omission of the sheath 30 in protection of the twisted pair 10 and maintenance of the twist structure thereof.

The sheath 30 may be made of any kind of polymer material similarly with the insulation coatings 13 of the insulated wires 11. That is, examples of the polymer material include polyolefin such as polyethylene and polypropylene, polyvinyl chloride, polystyrene, polytetrafluoroethylene, and polyphenylenesulfide. Among them, polyolefin, which is a non-polar polymer material, is especially preferable from the viewpoint of increasing the characteristic impedance of the communication cable 1. The sheath 30 may contain additives such as a flame retardant in addition to the polymer material as necessary. Although the sheath 30 may be composed of a plurality of layers or of a single layer, it is more preferably composed of a single layer in view of reduction of the diameter and cost of the communication cable 1 by simplification of the configuration.

[Material of Conductors]

A description of specific examples of the copper alloy wires to be used as conductors 12 of the insulated wires 11 in the communication cable 1 according to the above-described embodiment will be provided below.

Copper alloy wires according to a first example has the following ingredients composition:

Fe: 0.05 mass % or more and 2.0 mass or less;

Ti: 0.02 mass % or more and 1.0 mass % or less;

Mg: 0 mass % or more and 0.6 mass % or less (including a case where Mg is not contained in the alloy) ; and a balance being Cu and unavoidable impurities.

The copper alloy wires having the above-described ingredients composition have a very high tensile strength. Particularly when the copper alloy wires contain 0.8 mass % or more of Fe or 0.2 mass % or more of Ti, an especially high tensile strength is achieved. Further, the tensile strength of the wires may be improved when the diameter of the wires is reduced by increasing drawing reduction ratio or when the wires are subjected to a heat treatment after drawn. Thus, the conductors 11 having the tensile strength of 400 MPa or higher can be obtained.

Copper alloy wires according to a second example has the following ingredients composition:

Fe: 0.1 mass % or more and 0.8 mass % or less;
P: 0.03 mass % or more and 0.3 mass % or less;
Sn: 0.1 mass % or more and 0.4 mass % or less; and
a balance being Cu and unavoidable impurities.

The copper alloy wires having the above-described ingredients composition have a very high tensile strength. Particularly when the copper alloy wires contain 0.4 mass % or more of Fe or 0.1 mass % or more of P, an especially high tensile strength is achieved. Further, the tensile strength of the wires may be improved when the diameter of the wires is reduced by increasing drawing reduction ratio or when the wires are subjected to a heat treatment after drawn. Thus, the conductors 11 having the tensile strength of 400 MPa or higher can be obtained.

EXAMPLE

A description of the present invention will now be specifically provided with reference to examples; however, the present invention is not limited to the examples.

[1] Examination Regarding Tensile Strength of Conductor

Firstly, possibility of reduction of the diameter of a communication cable by selection of the tensile strength of conductors was examined.

[Preparation of Samples]

(1) Preparation of Conductor

For each of samples A1 to A5, a conductor to be contained in the insulated wires was prepared. Specifically, an electrolytic copper of a purity of 99.99% or higher and master alloys containing Fe and Ti were charged in a melting pot made of a high-purity carbon, and were vacuum-melted to provide a mixed molten metal containing 1.0 mass % of Fe and 0.4 mass % of Ti. The mixed molten metal was continuously cast into a cast product of φ 12.5 mm. The cast product was subjected to extrusion and rolling to have a diameter of φ 8 mm, and then was drawn to provide an elemental wire of φ 0.165 mm. Seven elemental wires as produced were stranded with a stranding pitch of 14 mm, and then the stranded wire was compressed. Then the compressed wire was subjected to a heat treatment where the temperature of the wire was kept at 500° C. for eight hours. Thus, a conductor having a conductor cross section of 0.13 $mm^2$ and an outer diameter of 0.45 mm was prepared.

Tensile strength and breaking elongation of the copper alloy conductor thus prepared were evaluated in accordance with JIS Z 2241. For the evaluation, the distance between evaluation points was set at 250 mm, and the tensile speed was set at 50 mm/min. According to the result of the evaluation, the copper alloy conductor had a tensile strength of 490 MPa and a breaking elongation of 8%.

As conductors for Samples A6 to A8, a conventional strand wire made of pure copper was used. The tensile strength, breaking elongation, conductor cross section, and outer diameter of the conductors were measured in the same manner as described above, and are shown in Table 1. The conductor cross section and outer diameter adopted for the conductors were those which can be assumed to be substantial lower limits for a pure copper electric wire defined by the limited strength of the conductors.

(2) Preparation of Insulated Wires

Insulated wires were prepared by formation of insulation coatings made of a polyethylene resin around the above-prepared copper alloy and pure copper conductors through extrusion. The thicknesses of the insulation coatings for the samples were as shown in Table 1. The eccentricity ratio of the insulated wires was 80%.

(3) Preparation of Communication Cables

Two insulated wires as prepared above were twisted each other with a twist pitch of 25 mm, to provide twisted pairs. The twisted pairs had the first twist structure (without wrenching). Then, sheaths were formed by extrusion of a polyethylene resin around the prepared twisted pairs. The sheaths took the form of loose jackets having a thickness of 0.4 mm. The gaps between the sheaths and the insulated wires had an outer area ratio of 23%. The adhesion strength of the sheaths to the insulated wires was 15 N. Thus, the communication cables as Samples A1 to A8 were prepared.

[Evaluation]

(Finished Outer Diameter)

Outer diameters of the prepared communication cables were measured for evaluation of whether the diameters of the cables were successfully reduced.

(Characteristic Impedance)

Characteristic impedances of the prepared communication cables were measured. The measurement was performed by the open-short method with the use of an LCR meter.

[Results]

Table 1 shows the configurations and evaluation results of the communication cables as Samples A1 to A8.

TABLE 1

| | Insulated Wire | | | | | | | | |
|---|---|---|---|---|---|---|---|---|---|
| | Conductor | | | | | Thickness of | | Finished | |
| Sample No. | Material | Tensile Strength [MPa] | Elongation [%] | Cross-sectional Area [$mm^2$] | Outer Diameter [mm] | Insulation Coating [mm] | Outer Diameter [mm] | Outer Diameter [mm] | Characteristic Impedance [Ω] |
| A1 | Copper | 490 | 8 | 0.13 | 0.45 | 0.30 | 1.05 | 2.9 | 110 |
| A2 | Alloy | | | | | 0.25 | 0.95 | 2.7 | 102 |
| A3 | | | | | | 0.20 | 0.85 | 2.5 | 96 |
| A4 | | | | | | 0.18 | 0.81 | 2.4 | 91 |
| A5 | Copper Alloy | 490 | 8 | 0.13 | 0.45 | 0.15 | 0.75 | 2.3 | 86 |
| A6 | Pure | 220 | 24 | 0.22 | 0.55 | 0.30 | 1.15 | 3.1 | 97 |
| A7 | Copper | | | | | 0.25 | 1.05 | 2.9 | 89 |
| A8 | | | | | | 0.20 | 0.95 | 2.7 | 80 |

According to the evaluation results shown in Table 1, Samples A1 to A3, which contain the copper alloy conductors and have the conductor cross-sectional area smaller than 0.22 $mm^2$, have higher characteristic impedances than Samples A6 to A8, which contain the pure copper conductors and have the conductor cross-sectional area of 0.22 $mm^2$, though the insulation coating of Samples A1 to A3 have the same thicknesses as those of Samples A6 to A8, respectively. Samples A1 to A3 all have characteristic impedances in the range of 100±10 Ω, which is required for Ethernet communication, while Samples A7 and A8 have particularly low impedances out of the range of 100±10 Ω.

The above-observed tendency in the characteristic impedances can be interpreted as a result of the smaller diameter of the copper alloy conductors and the smaller distance therebetween than those of the pure copper conductors. Consequently, the copper alloy conductors can have the small thickness of the insulation coatings smaller than 0.30 mm while ensuring the characteristic impedances of 100±10 Ω; the thickness can be reduced to 0.18 mm at the minimum. Reduction of the thickness of the insulation coatings, as well as reduction of the diameter of the conductors itself, thus serves to reduce the finished outer diameter of the communication cable.

For example, Sample A3, containing the copper alloy conductors, and Sample A6, containing the pure copper conductors, have almost the same characteristic impedance values. When the finished outer diameters of the samples are compared, however, the communication cable as Sample A3, containing the copper alloy conductors, has the 20% smaller finished diameter since the conductors have smaller diameters.

Meanwhile, when the insulation coatings formed around the copper alloy conductors are too thin, as in the case of Sample A5, the characteristic impedance may be out of the range of 100±10 Ω. Thus, a characteristic impedance of 100±10 Ω can be achieved when insulation coatings having an appropriate thickness are formed around copper alloy conductors having a reduced diameter.

[2] Examination Regarding Type of Sheath

Next, possibility of reduction of the diameter of the communication cable depending on the type of the sheath was examined.

[Preparation of Samples]

Communication cables were prepared in the same manner as Samples A1 to A4 in Examination [1] described above. The eccentricity ratio of the insulated wires was 80%. The twisted pairs had the first twist structure (without wrenching). Here, two types of samples were prepared that have sheaths taking the form of loose jackets as shown in FIG. 1 and filled jackets as shown in FIG. 2, respectively. For the both types of samples, the sheaths were formed of polypropylene. The thickness of the sheaths was controlled by the shapes of die and point used; the thickness was 0.4 mm for the loose jacket type, and was 0.5 mm for the filled jacket type at the thinnest part. The gaps between the loose jacket sheaths and the insulated wires had an outer area ratio of 23%. The adhesion strength of the sheaths to the insulated wires was 15 N. Several samples containing insulated wires having different thicknesses of insulation coatings were prepared as samples having loose and filled jacket sheaths, respectively.

[Evaluation]

Characteristic impedances of the samples prepared above were measured in the same manner as in Examination [1] described above. Further, outer diameters (i.e., finished outer diameters) and masses per unit length of the communication cables were measured for some of the samples.

Further, transmission characteristics IL, RL, LCTL, and LCL were measured for some of the samples with the use of a network analyzer.

[Results]

Figure 4:
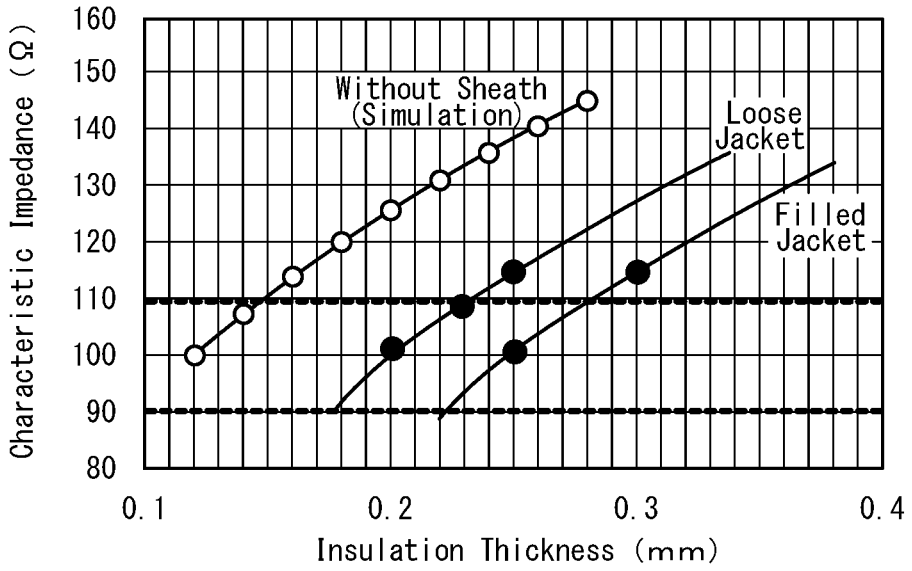
FIG. 4 shows relation between the thickness of insulation coatings of insulated wires and the characteristic impedance in the case where the sheath takes the form of a loose or filled jacket. A simulation result in the case having no sheath is also shown in the figure.

FIG. 4 shows plots of relation between the thickness of the insulation coatings of the insulated wires (i.e., insulation thickness) and the characteristic impedance measured for the cables having the loose and filled jacket sheaths, respectively. FIG. 4 also shows a simulation result of the relation between the insulation thickness and the characteristic impedance for a case having no sheath. The simulation result was obtained based on the above Formula (1), which is known as a theoretical formula representing a characteristic impedance of a communication cable having a twisted pair, (where $\varepsilon_{eff}$=2.6). Approximation curves based on Formula (1) are also shown for the measurement results in the cases having the two types of sheaths. The broken lines in FIG. 4 show a range in which the characteristic impedance is 100±10 Ω.

According to the results shown in FIG. 4, the characteristic impedances of the communication cables having the same insulation thickness are decreased by the presence of the sheaths, corresponding to increase of the effective dielectric constant; however, the loose jacket sheath less decreases the characteristic impedance and provides a higher value of characteristic impedance than the filled jacket sheath. In other words, the insulation thickness required to achieve a certain characteristic impedance is smaller in the case of the loose jacket sheath.

According to FIG. 4, the characteristic impedance of 100 Ω is observed when the insulation thickness is 0.20 mm for the loose jacket and when the thickness is 0.25 mm for the filled jacket. For these cases, insulation thicknesses and outer diameters and masses of the communication cables are summarized in Table 2 below.

TABLE 2

| | Sample B1 | Sample B2 |
|---|---|---|
| Type of Jacket | Loose Jacket | Filled Jacket |
| Insulation Thickness | 0.20 mm | 0.25 mm |
| Outer Diameter | 2.5 mm | 2.7 mm |
| Mass | 7.3 g/m | 10.0 g/m |

As shown in Table 2, the loose jacket sheath provides 25% smaller insulation thickness, 7.4% smaller outer diameter of the communication cable, and 27% smaller mass of the communication cable, than the filled jacket sheath. Thus, it is confirmed that a communication cable having a loose jacket sheath has a sufficiently high characteristic impedance even containing insulated wires having a smaller insulation thickness in a twisted pair, whereby the outer diameter and mass of the whole communication cable are reduced.

Further, the transmission characteristics of the communication cable having the loose jacket sheath and the insulation thickness of 0.20 mm were evaluated. It is confirmed based on the evaluation results that criteria IL≤0.68 dB/m (66 MHz), RL≥20.0 dB (20 MHz), LCTL≥46.0 dB (50 MHz), and LCL≥46.0 dB (50 MHz) are all satisfied.

[3] Examination Regarding Size of Gap

Next, relation between the size of the gap between the sheath and the insulated wires and the characteristic impedance was examined.

[Preparation of Samples]

Communication cables as Samples C1 to C6 were prepared in the same manner as Samples A1 to A4 in Examination [1] described above. Here, the sheaths took the form of loose jackets. The size of the gaps between the sheaths and the insulated wires was varied by selection of the shapes of the die and point. In the insulated wires, the conductor cross-sectional area of the insulated wires was 0.13 $mm^2$, and the thickness of the insulation coatings was 0.20 mm. The thickness of the sheaths was 0.40 mm. The eccentricity ratio was 80%. The adhesion strength of the sheaths to the insulated wires was 15 N. The twisted pairs had the first twist structure (without wrenching).

[Evaluation]

Sizes of the gaps in the samples prepared above were measured. For the measurement, the sample cables were embedded and fixed in an acrylic resin, and then were cut, to provide cross sections. The size of each gap was measured in the cross section as the ratio with respect to the entire cross-sectional area. The obtained sizes of the gaps are shown in Table 3 in the form of outer and inner area ratios defined above. Further, characteristic impedances of the samples were measured in the same manner as in Examination [1] described above. The values of characteristic impedance shown in Table 3 each have certain ranges because the values fluctuated during the measurement.

[Results]

Relation between the size of the gap and the characteristic impedance is summarized in Table 3.

TABLE 3

| Sample No. | Ratio of Gap: Outer Area Ratio [%] | Ratio of Gap: Inner Area Ratio [%] | Characteristic Impedance [Ω] |
|---|---|---|---|
| C1 | 4 | 15 | 86-87 |
| C2 | 8 | 26 | 90-92 |
| C3 | 15 | 39 | 95-97 |
| C4 | 23 | 50 | 99-101 |
| C5 | 30 | 56 | 103-106 |
| C6 | 40 | 63 | 108-113 |

As shown in Table 3, Samples C2 to C5, which have the gaps of the outer area ratios of 8% or more and 30% or less, exhibit the characteristic impedances of 100±10 Ω stably. Meanwhile, Sample C1, which has the gap of the outer area ratio less than 8%, has the characteristic impedance lower than the range of 100±10 Ω since the effective dielectric constant is too large because of the smallness of the gap. Sample C6, which has the gap of the outer area ratio more than 30%, has the characteristic impedance exceeding the range of 100±10 Ω. It is construed that the median value of the characteristic impedance of Sample C6 is high because the gap is too large, and the fluctuations in the characteristic impedance is large because the large gap easily allows variation of the position of the twisted pair inside the sheath or loosening of the twist structure thereof.

[4] Examination Regarding Adhesion Strength of Sheath

Next, relation between the adhesion strength of the sheath to the insulated wires and the temporal change of the characteristic impedance was examined.

[Preparation of Samples]

Communication cables as Samples D1 to D4 were prepared in the same manner as Samples A1 to A4 in Examination [1] described above. The sheaths took the form of loose jackets. The adhesion strength of the sheaths to the insulated wires was varied as shown in Table 4. Here, the adhesion strength was varied by control of the extrusion temperature of the resin material. The gaps between the sheaths and the insulated wires had an outer area ratio of 23%. In the insulated wires, the conductor cross-sectional area was 0.13 $mm^2$, and the thickness of the insulation coatings was 0.20 mm. The thickness of the sheaths was 0.40 mm. The eccentricity ratio of the insulated wires was 80%. The twisted pairs had the first twist structure (without wrenching). The twist pitch was 8 times of the outer diameter of the insulated wires.

[Evaluation]

Adhesion strengths of the sheaths were measured for the samples prepared above. Adhesion strength of each sheath was evaluated by a test in which a 30-mm long portion of the sheath was removed from a terminal end of the sample communication cable having a length of 150 mm, and then the twisted pair was pulled. The strength of pulling when the twisted pair fell out was recorded as the adhesion strength. Further, changes of the characteristic impedance of the samples were measured in a condition simulating a long-term use. Specifically, the sample communication cables were each bent 200 times along a mandrel having an outer diameter of φ 25 mm at an angle of 90°. Then, characteristic impedance was measured at the bent portions, and the change from the value before the bending was recorded.

[Results]

Relation between the adhesion strength of the sheath and the characteristic impedance is summarized in Table 4.

TABLE 4

| Sample No. | Adhesion Strength of Sheath [N] | Change of Characteristic Impedance |
|---|---|---|
| D1 | 15 | No Change |
| D2 | 7 | Increase of 3 Ω |
| D3 | 4 | Increase of 3 Ω |
| D4 | 2 | Increase of 7 Ω |

According to the results shown in Table 4, Samples D1 to D3, in which the sheaths have the adhesion strengths of 4 N or higher, exhibit small changes of 3 Ω or smaller in the characteristic impedances. These results indicate that the samples are not susceptible to the influence of the long-term use simulated by the bending with the use of the mandrel. Meanwhile, Sample D4, in which the sheath has the adhesion strength lower than 4 N, exhibits a large change of 7 Ω in the characteristic impedance.

[5] Examination Regarding Thickness of Sheath

Next, relation between the thickness of the sheath and the influence from the outside on the transmission characteristics was examined.

[Preparation of Samples]

Communication cables as Samples E1 to E6 were prepared in the same manner as Samples A1 to A4 in Examination [1] described above. The sheaths took the form of loose jackets. For Samples E2 to E6, the thickness of the sheaths was varied as shown in Table 5. For Sample E1, no sheath was formed. The gaps between the sheaths and the insulated wires had an outer area ratio of 23%. The adhesion strength of the sheaths was 15 N. In the insulated wires, the conductor cross-sectional area was 0.13 $mm^2$, and the thickness of the insulation coatings was 0.20 mm. The eccentricity ratio of the insulated wires was 80%. The twisted pairs had the first twist structure (without wrenching). The twist pitch was 24 times of the outer diameter of the insulated wires.

[Evaluation]

For the sample communication cables prepared above, changes in the characteristic impedance by the influence of other cables were evaluated. Specifically, characteristic impedances of the sample communication cables were each measured in an independent state. Further, characteristic impedances of the communication cables were each measured also in a state held with other cables. Here, the state held with other cables denotes a state where a sample cable is surrounded by six other cables (i.e., six PVC cables having an outer diameter of 2.6 mm) that are arranged approximately centrosymmetrically around the sample cable in contact with the outer surface of the sample cable, and the sample cable and the six other cables are together fixed by a PVC tape wound around them. Then, change of the characteristic impedance of each communication cable in the state held with other cables with respect to the independent state was recorded.

[Results]

Relation between the thickness of the sheath and the change of the characteristic impedance is summarized in Table 5.

TABLE 5

| Sample No. | Thickness of Sheath [mm] | Change of Characteristic Impedance |
|---|---|---|
| E1 | 0 (No Sheath) | Decrease of 10 Ω |
| E2 | 0.10 | Decrease of 8 Ω |
| E3 | 0.20 | Decrease of 4 Ω |
| E4 | 0.30 | Decrease of 3 Ω |
| E5 | 0.40 | Decrease of 3 Ω |
| E6 | 0.50 | Decrease of 2 Ω |

According to the results shown in Table 5, for Samples E3 to E6, which contain sheaths having the thickness of 0.20 mm or larger, the changes of the characteristic impedance by the influence of other cables are suppressed to 4 Ω or lower. Meanwhile, for Sample E1, which does not contain a sheath, and Sample E2, which contains a sheath having a thickness smaller than 0.20 mm, the changes of the characteristic impedances areas high as 8 Ω or higher. It is preferable that a change of a characteristic impedance of a communication cable of this type should be suppressed to 5 Ω or lower when the communication cable is used in the proximity of another cable in an automobile, for example, in the form of a wiring harness.

[6] Examination Regarding Eccentricity Ratio of Insulated Wires

Next, relation between the eccentricity ratio of the insulated wires and the transmission characteristics was examined.

[Preparation of Samples]

Communication cables as Samples F1 to F6 were prepared in the same manner as Samples A1 to A4 in Examination [1] described above. Here, the eccentricity ratio of the insulated wires was varied as shown in Table 6 by control of the conditions for formation of the insulation coatings. In the insulated wires, the conductor cross-sectional area was 0.13 $mm^2$, and the thickness of the insulation coatings was 0.20 mm (on average). The sheaths took the form of loose jackets. The thickness of the sheaths was 0.40 mm. The gaps between the sheaths and the insulated wires had an outer area ratio of 23%. The adhesion strength of the sheaths was 15 N. The twisted pairs had the first twist structure (without wrenching). The twist pitch was 24 times of the outer diameter of the insulated wires.

[Evaluation]

Transmission mode conversion characteristics (LCTL) and reflection mode transmission characteristics (LCL) of the sample communication cables prepared above were measured in the same manner as in Examination [2] described above. The measurement was performed in a frequency range of 1 to 50 MHz.

[Results]

Table 6 shows the eccentricities and the measurement results of the mode conversion characteristics. The values of the mode conversion characteristics shown in the table each indicate the minimum absolute values in the range of 1 to 50 MHz.

TABLE 6

| Sample No. | Eccentricity Ratio [%] | Transmission Mode conversion [dB] | Reflection Mode Conversion [dB] |
|---|---|---|---|
| F1 | 60 | 47 | 45 |
| F2 | 65 | 49 | 49 |
| F3 | 70 | 52 | 54 |
| F4 | 75 | 57 | 55 |
| F5 | 80 | 59 | 57 |
| F6 | 85 | 58 | 58 |

According to Table 6, in the cases of Samples F2 to F6, which have the eccentricity ratios of 65% or higher, the transmission and reflection mode conversions both satisfy the criteria of 46 dB or higher. Meanwhile, in the case of Sample F1, which has the eccentricity ratio of 60%, either the transmission or reflection mode conversion does not satisfy the criteria.

[7] Examination Regarding Twist Pitch of Twisted Pair

Next, relation between the twist pitch of the twisted pair and the temporal change of characteristic impedance was examined.

[Preparation of Samples]

Communication cables as Samples G1 to G4 were prepared in the same manner as Samples D1 to D4 in Examination [4] described above. Here, the twist pitch of the twisted pairs was varied as shown in Table 7. The adhesion strength of the sheaths to the insulated wires was 70 N.

[Evaluation]

Changes of the characteristic impedance by bending with the use of a mandrel were evaluated for the samples prepared above in the same manner as in Examination [4].

[Results]

Relation between the twist pitch of the twisted pair and the change of the characteristic impedance is summarized in Table 7. In Table 7, the twist pitches are shown as values based on the outer diameter of the insulated wires (of 0.85 mm): i.e., the values indicate how many times of the outer diameter of the insulated wires the twist pitch is.

TABLE 7

| Sample No. | Twist Pitch [Times] | Change of Characteristic Impedance |
|---|---|---|
| G1 | 15 | No Change |
| G2 | 30 | Increase of 3 Ω |
| G3 | 45 | Increase of 4 Ω |
| G4 | 50 | Increase of 8 Ω |

According to the results shown in Table 7, the changes of the characteristic impedance in the cases of Samples G1 to G3, which have the twist pitches of 45 times of the outer diameter of the insulated wires or smaller, are suppressed to 4 Ω or smaller. Meanwhile, the change of the characteristic impedance of Sample G4, which has the twist pitch larger than 45 times of the outer diameter of the insulated wires, reaches 8 Ω.

[8] Examination Regarding Twist Structure of Twisted Pair

Next, relation between the type of twist structure of the twisted pair and fluctuations in the characteristic impedance was examined.

[Preparation of Samples]

Communication cables as Samples H1 and H2 were prepared in the same manner as Samples D1 to D4 in Examination [4] described above. Here, the first twist structure (without wrenching) described above was adopted for Sample H1 while the second twist structure (with wrenching) was adopted for Sample H2. The twist pitches of the twisted pairs in both samples were 20 times of the outer diameter of the insulated wires. The adhesion strength of the sheaths to the insulated wires was 30 N.

[Evaluation]

Characteristic impedances of the samples prepared above were measured. The measurement was performed three times for each sample, and variation range of the characteristic impedance in the three times measurement was recorded.

[Results]

Table 8 shows the relation between the type of the twist structure and the variation range of the characteristic impedance.

TABLE 8

| Sample No. | Twist Structure | Variation Range of Characteristic Impedance |
|---|---|---|
| H1 | 1st (Without Wrenching) | 3 Ω |
| H2 | 2nd (With Wrenching) | 14 Ω |

The results shown in Table 8 indicate that the variation range of the characteristic impedance of Sample H1, in which the insulated wires are not wrenched, is smaller. This is interpreted as because influence of variation in line spacing, which may be caused by the wrenching, is avoided.

The foregoing description of the preferred embodiment of the present invention has been presented for purposes of illustration and description; however, it is not intended to be exhaustive or to limit the present invention to the precise form disclosed, and modifications and variations are possible as long as they do not deviate from the principles of the present invention.

Further, as described above, the sheath that covers the twisted pair does not necessarily take the form of a loose jacket, but may take the form of a filled jacket, depending on how much the diameter of the communication cable has to be reduced. The sheath may be omitted from the communication cable. In short, the communication cable may be one containing a twisted pair comprising a pair of insulated wires twisted with each other, each of the insulated wire comprising a conductor that has a tensile strength of 400 MPa or higher and an insulation coating that covers the conductor, the communication cable having a characteristic impedance of 100±10 Ω. In this case, preferable configurations described above may be applied to the elements of the communication cable, such as the thickness of the insulation coatings; the ingredients composition, and breaking elongation of the conductors; the outer diameter and eccentricity of the insulated wires; the twist structure and twist pitch of the twisted pair; the, thickness, and adhesion strength of the sheath; and the outer diameter and breaking strength of the communication cable. Any of the above-described preferable configurations applicable to the elements of the communication cable can be appropriately combined with the configuration of a communication cable containing a twisted pair comprising a pair of insulated wires twisted with each other, each of the insulated wire comprising a conductor that has a tensile strength of 400 MPa or higher and an insulation coating that covers the conductor, the communication cable having a characteristic impedance of 100±10 Ω. The communication cable produced by the combination would have a reduced diameter while simultaneously ensuring a required magnitude of characteristic impedance, and further would possess properties imparted by the respective configurations applied to the cable.

DESCRIPTION OF REFERENCE NUMERALS

1 Communication cable
10 Twisted pair
11 Insulated wire
12 Conductor
13 Insulation coating
30 Sheath

The invention claimed is:

1. A communication cable, comprising:
a twisted pair of insulated wires twisted with each other, each of the insulated wires comprising:
a conductor that has a tensile strength of 400 MPa or higher and a breaking elongation of 7% or higher; and
an insulation coating that covers the conductor,
a sheath covering a single one of the twisted pair, the twisted pair being adhered to a portion smaller than an entire inner surface of the sheath, wherein:
the twisted pair has a twist pitch of 15 times of an outer diameter of each of the insulated wires or larger;
the communication cable has no conductive shield inside or outside the sheath; and
the communication cable has a characteristic impedance of 100±10 Ω with the insulation coating having a thickness smaller than 0.35 mm and the conductor having a diameter equal to or smaller than 0.55 mm.

2. The communication cable according to claim 1, wherein each of the insulated wires has a conductor cross-sectional area smaller than 0.22 $mm^2$.

3. The communication cable according to claim 2, wherein the insulation coating of each of the insulated wires has a thickness of 0.30 mm or smaller.

4. The communication cable according to claim 3, wherein the outer diameter of each of the insulated wires is 1.05 mm or smaller.

5. The communication cable according to claim 4, wherein the twisted pair has the twist pitch of 45 times of the outer diameter of each of the insulated wires or smaller.

6. The communication cable according to claim 5, wherein each of the insulated wires is not wrenched about a twist axis of the insulated wire.

7. The communication cable according to claim 1, wherein the insulation coating of each of the insulated wires has a thickness of 0.30 mm or smaller.

8. The communication cable according to claim 1, wherein the outer diameter of each of the insulated wires is 0.81 mm or greater and 1.05 mm or smaller.

9. The communication cable according to claim 1, wherein the twisted pair has the twist pitch of 45 times of the outer diameter of each of the insulated wires or smaller.

10. The communication cable according to claim 1, wherein each of the insulated wires is not wrenched about a twist axis of the insulated wire.

11. A communication cable, comprising:

a twisted pair of a first insulated wire and a second insulated wire separate from the first insulated wire, the first insulated wire and the second insulated wire being twisted with each other;

each of the first insulated wire and the second insulated wire comprising:

a conductor that has a tensile strength of 400 MPa or higher and a breaking elongation of 7% or higher; and an insulation coating that covers the conductor; and a sheath covering the twisted pair of the first insulated wire and the second insulated wire, the sheath having an adhesion strength of 4 N or higher to the first insulated wire and the second insulated wire, wherein:

the communication cable has no conductive shield inside or outside the sheath; and the communication cable has a characteristic impedance of 100±10 Ω with the insulation coating having a thickness smaller than 0.35 mm and the conductor having a diameter equal to or smaller than 0.55 mm.

12. The communication cable according to claim 11, wherein the thickness of the sheath is 0.20 mm or larger.

13. The communication cable according to claim 11, wherein the adhesion strength of the sheath is measured by a test in which a 30 mm-long portion of the sheath is removed from a terminal end of a sample communication cable having a length of 150 mm, and then the twisted pair is pulled from the sheath.

14. The communication cable according to claim 11, wherein each of the first and second insulated wires has an outer diameter of 0.81 mm or greater and 1.05 mm or smaller.

15. The communication cable according to claim 11, wherein the twisted pair has a twist pitch of 15 times of an outer diameter of each of the first and second insulated wires or larger and 45 times of the outer diameter or smaller.

16. The communication cable according to claim 11, wherein the insulation coating of each of the first and second insulated wires has a thickness of 0.30 mm or smaller.

17. The communication cable according to claim 11, wherein the twisted pair is adhered to a portion smaller than an entire inner surface of the sheath, while maintaining the adhesion strength of 4 N or higher between the sheath and the twisted pair.

* * * * *